United States Patent [19]

Levasseur

[11] Patent Number: 4,637,523

[45] Date of Patent: Jan. 20, 1987

[54] STAMP SCANNING AND DISPENSING MEANS AND METHOD

[75] Inventor: Joseph L. Levasseur, St. Louis County, Mo.

[73] Assignee: Coin Acceptors, Inc., St. Louis, Mo.

[21] Appl. No.: 699,470

[22] Filed: Feb. 8, 1985

[51] Int. Cl.[4] ..... G07F 11/00; G07F 1/00

[52] U.S. Cl. ..... 221/13; 221/21; 221/25; 221/70; 221/71; 194/239

[58] Field of Search ..... 194/1 N, 2, 10, DIG. 26, 194/239; 221/2, 8, 9, 10, 13, 21, 25, 69, 70, 71, 72; 356/71; 250/556; 209/534; 377/53; 101/227; 226/10, 24, 45

[56] References Cited

U.S. PATENT DOCUMENTS

| | | | |
|---|---|---|---|
| 3,621,964 | 11/1971 | Riddle | 194/10 |
| 3,938,663 | 2/1976 | Carnes et al. | 209/534 |
| 3,978,958 | 9/1976 | Zandstra | 194/2 |
| 4,434,911 | 3/1984 | Sakura | 221/2 |
| 4,510,380 | 4/1985 | Uchida et al. | 235/379 |

*Primary Examiner*—H. Grant Skaggs
*Assistant Examiner*—Jay I. Alexander
*Attorney, Agent, or Firm*—Haverstock, Garrett & Roberts

[57] ABSTRACT

A system for scanning and dispensing postage stamps from a roll of stamps, including a scanning circuit for optically scanning each individual stamp on a stamp roll as the stamp passes thereby in order to detect the degree of opacity of such stamp and to produce a scanning output signal representative of the degree of opacity, an examination circuit including a first circuit portion operable to determine if an individual stamp boundary has been encountered and to produce a boundary detection signal in such event, and a second circuit portion responsive to such scanning output signal to determine if the degree of opacity detected identifies a non-blank stamp and to produce a non-blank status detection signal in such event, and a dispensing control circuit responsive to an externally generated dispense request signal and to the production of one or more boundary detection signals and non-blank status detection signals to control the operation of stamp movement and detaching devices. The first circuit portion is preferably responsive to the scanning output signal to determine if an individual stamp boundary has been encountered and the stamp movement device preferably includes friction roller members.

57 Claims, 10 Drawing Figures

STAMP SCANNING AND DISPENSING MEANS AND METHOD

BACKGROUND OF THE INVENTION

The present invention relates to a stamp scanning and dispensing means and method, and, more specifically, to a means and method for scanning stamps on a roll or strip of postage stamps and for controlling the dispensing thereof so that a blank stamp is not vended to a customer as a valid stamp.

Numerous devices are known and have been employed for many years now for dispensing postage stamps, particularly for dispensing postage stamps from stamp rolls. Such devices range from simple, mechanically operated devices that dispense a single stamp upon the deposit of a coin in the exact amount of such stamp to complex electronic control systems, including systems such as those disclosed in U.S. Pat. No. 4,008,792, the constructions in which patent were developed to control the vending of postage stamps by both selection and quantity when appropriate credit has been entered by a customer. All of the known dispensing devices, depending upon their particular designs and constructions, the selection made by the customer, and the amount of money deposited, operate to vend to the customer an appropriate number of stamps from the end of the stamp roll or strip. In the unfortunate event that one or more stamps on the roll or strip are blank for some reason, such as due to misprinting, a customer may be vended a worthless bit of paper. Although such problem is undoubtedly annoying and aggravating to the customer who has received the blank stamp, it has generally been considered only a minor problem when the authority issuing or providing the rolls or strips of stamps has maintained good quality control of its printing operations. However, the problem becomes more severe as quality control standards are relaxed, and is a monumental problem if the issuing authority regularly provides rolls or strips of stamps, either by chance, accident, or design, with blank stamps interposed among the valid stamps on a roll or strip.

It should be appreciated that in some countries postage stamps are not routinely available in individual roll or strip form. In some of such countries postage stamps may be printed only on block rolls wherein a 10×10 block of stamps on the roll is separated from a succeeding 10×10 block of stamps by a single column of blank stamps between the two stamp blocks. The block roll is typically cut into block lengths by appropriate cutting means that cut the block roll at the locations of the columns of blank stamps that separate two blocks of valid stamps from one another, and the stamps are then made available to the public in such block form. Because of the particular machinery set-up and printing techniques employed by such issuing authorities, and/or the high cost of acquiring new machinery or of modifying existing equipment to provide for the printing of continuous runs of valid stamps suitable for slitting into individual stamp rolls, such authorities do not anticipate or envision making individual stamp rolls of continuous stamp runs available to the public in the immediate future. It is recognized that in such instances a form of individual stamp rolls could be relatively easily obtained from the block rolls by slitting the block rolls lengthwise along the perforations between rows of stamps and by cutting the rolls at a suitable point to provide an appropriate number of stamps on the individual stamp rolls. The resulting individual stamp rolls would have blank stamps disposed periodically among the non-blank stamps, however, as a result of which known stamp dispensing constructions could not be advantageously employed to vend such stamps.

Even where individual stamp rolls of high quality, which contain no blank stamps interposed thereon among valid stamps, are provided by an issuing authority, dispensing problems may arise if the sizes of the stamps on a particular roll are not uniform or if stamp sizes vary from roll to roll, such as might be the case if differently valued stamps are differently sized. In such instances, dispensing problems would be encountered because many of the known stamp dispensing constructions employ a stamp drive means that includes a drive roller with spaced sets of upstanding sprockets thereon for engaging the perforations between adjacent stamps and for advancing the stamps as the wheel turns, with the spacings between the sets of sprockets having been selected to correspond to the size of the stamps to be vended. Such drive means works well with the particular sized stamps that the sprocket spacing is designed for, but will not work properly if a differently sized stamp is provided since the spacing between the perforations on the stamp roll containing the differently sized stamps will no longer be the same. Consequently, constructions that include such a sprocket drive means are generally restricted to one specific size of stamp for vending.

SUMMARY OF THE INVENTION

The present invention overcomes the noted problems by providing a means for scanning and dispensing stamps from stamp strips that may include blank stamps thereon, which scanning and dispensing means can also be advantageously employed with the optional stamp movement means of the invention to permit the dispensing of stamps from a variety of stamp strips each of which may have differently sized stamps thereon. In its presently preferred form, the invention includes a means for optically scanning an individual stamp on a stamp strip as such stamp passes the scanning means in order to detect the degree of opacity of such stamp and to produce a scanning output signal representative of the degree of opacity, a first means operable to determine if an individual stamp boundary has been passed and to produce a boundary detection signal in such event, which first means is preferably responsive to such scanning output signal, a second output signal responsive to such scanning means to determine if the degree of opacity detected identifies a non-blank stamp and to produce a non-blank status detection signal in such event, and dispensing control means responsive to dispense request signals, boundary detection signals, and non-blank status detection signals to control stamp movement and detaching means. In detecting the degree of opacity of each stamp, the scanning means may, depending upon the positioning thereof, detect either the degree of translucency or the degree of reflectivity of each stamp, both of which measurements are considered to be measurements of the degree of opacity. The dispense request signal is typically generated in vending applications by a vend control means when and if the amount of credit entered by the customer is at least equal to the vend price of the stamp selection selected by the customer, but, in certain instances, could be generated more directly, such as by the actuation of a switch means by the user of the dispensing system, or as a result of other types of operations. Optionally, the stamp movement means employed in the dispensing system may include frictional drive members for advancing the stamps under control of the dispensing control means.

In operation, the dispensing control means is responsive to a dispense request signal to effect operation of the stamp movement means, thereby causing the stamps on the stamp roll to begin moving past the scanning means. As the stamps move past the scanning means such scanning means produces a signal representative of the opacity of the stamp area then moving past the scanning means. Such signal is monitored by both the first and second means, and when such means detect a signal representative of a degree of opacity indicative of a stamp boundary or of a non-blank stamp they produce appropriate respective boundary detection signals and non-blank status detection signals. Subsequent to receipt of a dispense request signal and detection of a stamp boundary, the dispensing control means responds to the production of a non-blank status detection signal prior to detection of the next stamp boundary to effect, when such next stamp boundary is reached, de-actuation of the stamp dispensing means and actuation of the stamp detaching means. Unless a non-blank status detection signal is produced by the second means during the appropriate period of stamp examination, the stamp being scanned will not be considered a non-blank stamp and the dispensing control means will not act to effect de-actuation of the stamp movement means or actuation of the stamp detaching means. In such event, the present invention will proceed to scan the next stamp on the roll, and will continue in such manner until a non-blank status detection signal is detected by the dispensing control means during a stamp examination. Thus, if a blank stamp occurs in a stamp roll, the stamp scanning and dispensing means of the present invention will operate in such a manner that the blank stamp is not treated as a valid stamp and vended to a customer as a valid stamp. The blank stamp could, in some applications, be detached from the roll and redirected so as not be be dispensed by the dispensing means, but it has been found that it is generally easier, and still highly acceptable, to permit the blank stamp to be dispensed by the dispensing means, but only along with a non-blank stamp.

The present invention thus provides a stamp scanning and dispensing means that can be employed with stamp rolls or strips that may contain blank stamps and that will operate in such a manner that a customer will not be vended only a blank stamp, but may be assured that he will receive a non-blank stamp for his money. Such invention also permits the vending of stamps or other stamp-like items provided on a roll or a strip when the boundaries between the individual items can be determined by the occurrence at the item boundary of a feature or some indicia that causes the degree of opacity at such boundary to be distinguishable from the degree of opacity between the boundaries of both blank and non-blank items. Additionally, if friction drive members are employed, the present invention provides a means for dispensing stamps or other stamp-like items from rolls or strips when the sizes of such stamps or stamp-like items may vary from roll to roll, from strip to strip, or from item to item on an individual roll or strip.

In light of what has been discussed hereinabove, it will be appreciated that a principal object of the present invention is to provide a novel means for scanning and dispensing stamps or stamp-like items.

A further object of the present invention is to provide an improved stamp dispensing means that may be employed in stamp vending systems to ensure that blank stamps that may be included on a roll or strip of stamps being vended will not be dispensed therefrom to the customer as valid stamps.

A still further object of the present invention is to teach the optical scanning of stamps or stamp-like items to detect blank stamps or stamp-like items.

Another important object is to provide a dispensing means that can be employed to dispense during each dispensing operation at least one non-blank item from a roll or strip of items that includes both blank and non-blank items and boundary features or indicia between successive items on the roll or strip.

An additional object is to provide a dispensing means for dispensing individual items from rolls or strips of stamps or stamp-like items wherein the stamps or stamp-like items are not required to have physical perforations at their boundaries with other stamps or stamp-like items on the roll or strip.

A still further object of the present invention is to provide a dispensing means for dispensing individual items from rolls or strips of stamps or other stamp-like items, which dispensing means can be employed with rolls or strips where the sizes of the stamps or stamp-like items on such rolls or strips vary from roll to roll, from strip to strip, or even from item to item on an individual roll.

Another object is to provide a stamp scanning and dispensing means that can detect blank stamps and which is self-loading.

BRIEF DESCRIPTION OF THE DRAWINGS

These and other objects and advantages of the present invention will become apparent after considering the following detailed specification in conjunction with the accompanying drawings, wherein.

DESCRIPTION OF PREFERRED EMBODIMENTS

Figure 1:
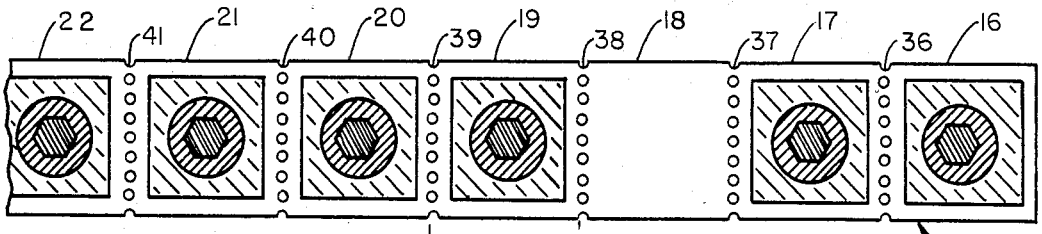
FIG. 1 is a top, plan view of a strip segment of a typical stamp roll as it is being unwound, which segment includes thereon a blank stamp disposed between two non-blank stamps, with the arrow indicating the direction of movement of the stamps, and wherein the lining indicates shading on the stamps.

Referring now to the drawings more particularly by reference numbers, wherein like numbers refer to like components, number 15 in FIG. 1 identifies a segment of a strip of stamps, the individual stamps 16–22 of which are delimited from one another by perforations 36–41. Such segment may be part of a strip of stamps made available in any of numerous forms, such as in flat, strip form, in fanfold form, or on a stamp roll, but, for ease of reference and description herein, such segment and other segments referred to hereinafter will be described as segments of stamp rolls.

Figure 2:
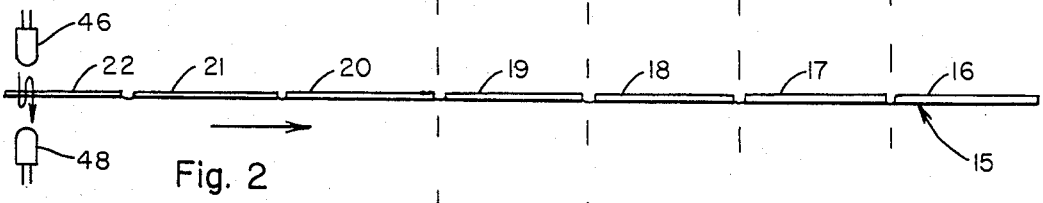
FIG. 2 is a side view of the stamps depicted in FIG. 1, including at the left side thereof a representation of optical scanning means between which the stamps will have passed during their movement.
Figure 3:
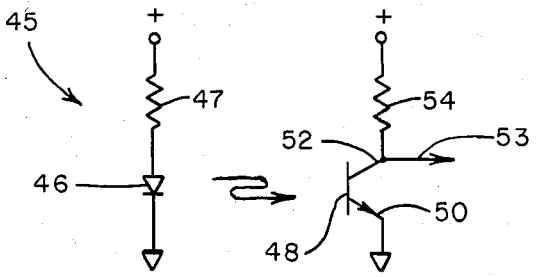
FIG. 3 is a schematic representation of one possible embodiment of an optical scanning means in conjunction with enabling circuitry therefor.

As the stamp segment 15 is unwound from a roll of stamps, the individual stamps on such roll may be positioned to move between a light emitting diode 46 and a phototransistor 48 as depicted in FIG. 2, as a consequence of which the conductivity of the phototransistor 48 will vary depending upon the degree of translucency of the area of the segment 15 positioned between the light emitting diode 46 and phototransistor 48 at any particular time. FIG. 3 schematically depicts a simple optical scanning means circuit 45 that may be employed in the present invention. Such circuit includes a light-emitting diode 46, whose CATHODE is connected to ground and whose anode is connected through a resistor 47 to a positive voltage source, and a phototransistor 48 positioned to be responsive to emission of light by the light-emitting diode 46. Such phototransistor 48 is connected such that emitter 50 thereof is connected to ground and collector 52 is connected to an output lead 53 and, through resistor 54, to a positive voltage source. If the light path between light-emitting diode 46 and phototransistor 48 is blocked so that phototransistor 48 detects no light emission from the light-emitting diode 48, phototransistor 48 will be gated OFF and the voltage output on lead 53 will be approximately equal to the positive voltage source. On the other hand, if nothing is positioned in the light path, phototransistor 48 will be gated ON and the voltage output on lead 53 will be approximately equal to ground. If translucent items are positioned in the light path, the amount of light transmitted therethrough may be insufficient to gate phototransistor fully ON, but may nevertheless be sufficient to cause phototransistor 48 to begin conducting and to operate in its active region. In such event, the voltage output on lead 53 will depend upon the translucency of the item disposed in the light path. Generally, the darker an item, the less translucent it is. Thus, the darker the shading on a piece of paper, the less translucent such area of the paper is.

Figure 4:
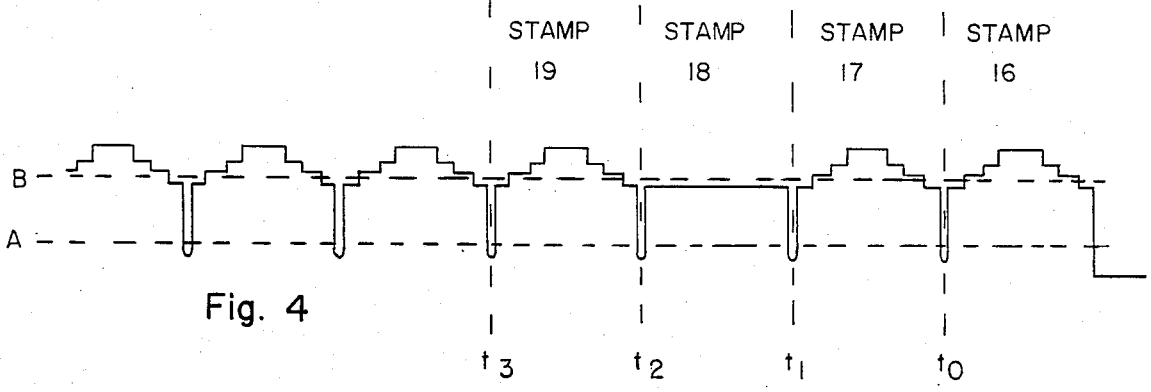
FIG. 4 is a time-voltage diagram along the direction of movement of the stamps depicted in FIGS. 1–2, depicting the output of the circuit of FIG. 3 during such time of movement.

With the foregoing in mind, it will be readily understood that FIG. 4 is a time-voltage diagram depicting the voltage output on lead 53 of the circuit of FIG. 3 during the movement of the stamp roll segment 15 of FIGS. 1–2 between the light emitting diode 46 and the phototransistor 48 of the optical scanning circuit 45. It can be readily observed that the lowest output voltages on lead 53 occur when perforations on the stamp roll segment are positioned between the light emitting diode 46 and the phototransistor 48, and that the highest output voltages occur when the dark center portions of the stamps are positioned between the light emitting diode 46 and the phototransistor 48. It can also be observed that when a blank stamp, such as stamp 18, passes between the scanning means the output voltage has an intermediate value between the voltage level that occurs when perforations are disposed between the scanning means and the voltage levels that occur when printed areas of a stamp pass between the scanning means. It may be observed that, by proper selection of voltage levels, such as the levels denoted by the symbols A and B, it is possible to examine the output signal on lead 53 as stamps pass between the scanning means to detect occurrences of perforations on the stamps and to check for the presence or absence of printing on the stamps.

Figure 5:
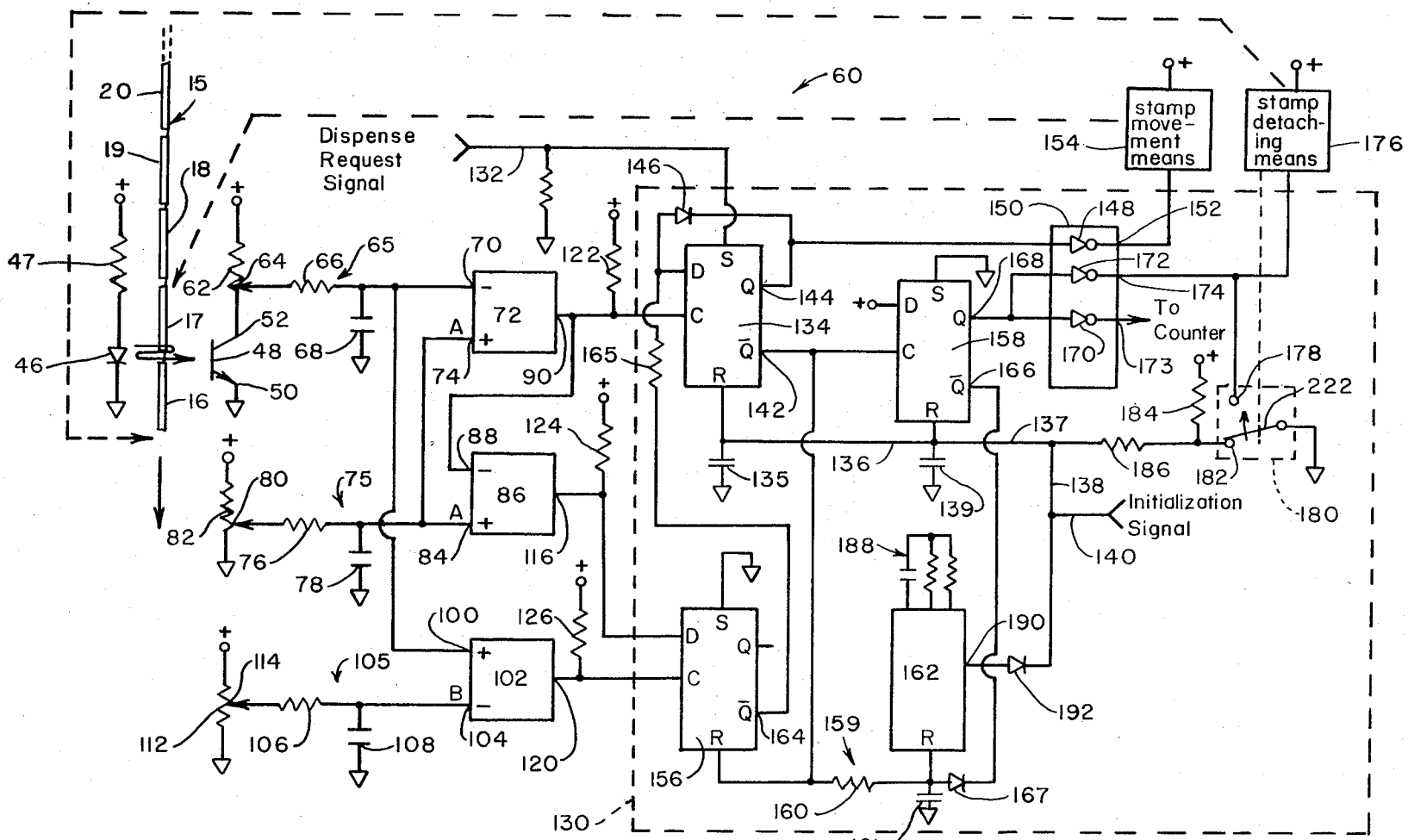
FIG. 5 is circuit schematic for one embodiment of the control circuitry of the present invention.

FIG. 5 shows a preferred embodiment of the present invention wherein the number 60 identifies the optical scanning and dispensing means of the present invention and wherein the scanning circuit includes light emitting diode 46, connected in series circuit with resistor 47 between ground and a positive voltage source, and phototransistor 48, whose emitter 50 is connected to ground and whose collector 52 is connected through a potentiometer 62 to a positive voltage source. The adjustable contact 64 of the potentiometer 62 is connected through a filter circuit 65 including resistor 66 and capacitor 68 to the negative (−) input 70 of a voltage comparator means 72, the positive (+) input 74 of which is connected through a filter circuit 75 including resistor 76 and capacitor 78 to the adjustable contact 80 of a potentiometer 82 that is connected between ground and a positive voltage source. The output of filter circuit 75 is also connected to the positive (+) input 84 of a voltage comparator means 86, the negative (−) input 88 of which is connected to the output 90 of voltage comparator means 72. The output of the filter circuit 65 is also provided to the positive (+) input 100 of voltage comparator means 102, the negative (−) input 104 of which is connected through filter circuit 105 including resistor 106 and capacitor 108 to adjustable contact 114 of potentiometer 112, which potentiometer is connected between ground and a positive voltage source.

The voltage comparator means 72, 86, and 102 of the preferred embodiment function in such a manner that whenever the voltage present at the negative (−) input is greater than the voltage present at the positive (+) input, a LO output results. Typical of voltage comparator means that operate in such a manner are the voltage comparators included on LM339 chips produced by National Semiconductor. In order to effect proper operation of such LM339 voltage comparators the outputs thereof must be connected to a positive voltage source through a pull-up resistor so that whenever the voltage at the negative (−) input is less than the voltage at the positive (+) input, a HI signal will be ensured at the output. Consequently, in the circuit of FIG. 5, output 90 of voltage comparator means 72 is shown connected to a positive voltage source through pull-up resistor 122, output 116 of voltage comparator means 86 is shown connected to a positive voltage source through pull-up resistor 124, and output 120 of voltage comparator means 102 is shown connected to a positive voltage source through pull-up resistor 126. Such circuitry ensures that the outputs of the voltage comparator means will remain HI unless the input conditions effect the production of a LO signal on the output.

A dispensing control means 130, which is responsive to the signals produced at the outputs of voltage comparator means 72, 86, and 102, and to the production of a dispense request signal on lead 132, is provided to control the operation of stamp movement means 154 and stamp detaching means 176. In the preferred embodiment depicted in FIG. 5, the dispensing control means 130 includes a first D-type flip-flop 134, the set (S) input of which is connected to an input lead 132 over which a dispense request signal may be supplied to dispensing control means 130, and the clock (C) input of which is connected to output 90 of voltage comparator means 72. The reset (R) input of such flip-flop 134, which is connected to one side of a grounded capacitor 135 whose function, as will become apparent hereinafter to those skilled in the art, is to help alleviate problems that could be encountered due to switch contact bounce, is also connected through leads 136, 137, 138, and 140 to receive an initialization signal that is produced during power-up operations to effect initialization of the dispensing control means 130, including the resetting of flip-flop 134, with the result that a HI signal is initially produced at the $\overline{Q}$ output 142 of flip-flop 134 and a LO signal is produced on the Q output 144, which output is connected through diode 146 to the data (D) input of flip-flop 134 so as to maintain a LO signal on such input whenever a LO signal is present on Q output 144. The signal present at Q output 144 is also provided to a driver means 148 within a driver array means 150, which driver array means may, as in the preferred embodiment, be a series ULN-2003 high-voltage, high-current Darlington transistor array. The signal produced at output 152 of the driver array means 150, which signal is inverted by driver means 148, controls operation of stamp movement means 154.

The $\overline{Q}$ output 142 of flip-flop 134 is connected to the reset (R) input of a second D-type flip-flop 156 and to the clock (C) input of a third D-type flip-flop 158, and is further connected through an RC circuit 159 including resistor 160 and capacitor 161 to the reset (R) input of timing-out circuit means 162. The set (S) input of flip-flop 156 is connected to ground and the data (D) and clock (C) inputs thereof are connected, respectively, to output 116 of voltage comparator means 86 and to output 120 of voltage comparator means 102. The $\overline{Q}$ output 164 of such flip-flop is connected through a resistor 165 to the data (D) input of flip-flop 134, the purpose of which connection will become clear from the operational description appearing hereinafter.

The reset (R) input of the third D-type flip-flop 158, which, like the reset (R) input of flip-flop 134, is connected to one side of a grounded capacitor 139 whose function is to help alleviate problems that could be encountered due to switch contact bounce, is also connected through leads 137, 138, and 140 to receive the initialization signal that is produced during power-up to initialize the dispensing control means, which initialization includes the resetting of such flip-flop 158. The set (S) input of such flip-flop is tied to ground and the data (D) input thereof is connected to a positive voltage source. $\overline{Q}$ output 166 is connected through diode 167 to the reset (R) input of timing-out means 162 so that the occurrence of a LO signal on $\overline{Q}$ output 166 will enable timing-out means 162, as will be further explained hereinafter. The Q output 168 of flip-flop 158 is connected to driver means 170 and 172 in the driver array means 150. The signals which result at outputs 173 and 174 of driver array means 150 are inverted from the signal appearing at Q output 168 of flip-flop 158. The signal at output 173 may optionally be provided to a counter means in certain applications, such as when the embodiment of FIG. 5 is employed in association with a vend control system that permits the vending of more than one stamp under certain credit entry and vend selection conditions or that keeps track, for inventory or other purposes, of each non-blank stamp that is vended. The signal at output 174 controls the operation of stamp detaching means 176 and is also provided to the normally open contact 178 of switch means 180, the common contact of which is connected to ground and the normally closed contact 182 of which is connected both to a positive voltage source through resistor 184 and to leads 137 and 138 through resistor 186.

Connected to the timing-out means 162 is a RC tank circuit 188, the values of the components of which can be selected to determine the basic internal timing of timing-out means 162. Such timing-out means, which may be a CD 4060B multi-staged ripple-carry binary counter/divider and oscillator chip, includes at least one output 190 at which is produced a timed-out signal which occurs at a specified time interval following the enabling of timing-out means 162. When and if timing-out means 162 remains enabled for a long enough period for such means to complete a timing-out operation and to produce a HI signal at output 190, such signal will be provided through diode 192, which will typically be forward biased at such time, to the reset (R) inputs of flip-flops 134 and 158.

As has been set forth hereinbefore, the embodiment of FIG. 5 includes three (3) D-type flip-flops, each of which includes a data (D) input, a clock (C) input, a direct set (S) input, and a direct reset (R) input. In the absence of direct set and direct reset inputs, such flip-flops are triggered by the leading (positive going voltage) edges of clock (C) input signals, and the data (D) inputs thereto then become locked out until the clock (C) input returns to a LO state. Thus, each of the D-type flip-flops triggers on the leading (positive) edge of the clock (C) pulse, and once the clock has passed threshold changes on the data (D) input will not affect the state of the flip-flop due to a lock-out circuit. The data (D) input is not thereafter unlocked until the clock input threshold voltage of the trailing (negative going voltage) edge has been passed. Consequently, in the absence of direct set and direct reset inputs, the leading edge of a clock pulse will trigger the flip-flop causing it to set if data (D) input is in a HI state and to reset if data (D) input is in a LO state. The occurrence of a HI signal at the direct reset (R) input will override any triggering by the clock (C) pulses and cause the flip-flop to be directly reset. Similarly, the occurrence of a HI signal at the direct set (S) input will override any triggering by the clock (C) pulses and cause the flip-flop to be directly set. Having now described the various components in the embodiment of FIG. 5, and the interconnections therebetween, the operation of such embodiment can be explained.

During power-up of the FIG. 5 embodiment, a HI initialization signal is applied to lead 140, and such signal is communicated over leads 138, 137, and 136 to the reset (R) inputs of D-type flip-flops 134 and 158 thereby causing the $\overline{Q}$ output 142 of flip-flop 134 and $\overline{Q}$ output 166 of flip-flop 158 to both go HI. The resulting HI signal on $\overline{Q}$ output 142 of flip-flop 134 is provided to the reset (R) input of flip-flop 158, thereby effecting a HI signal on $\overline{Q}$ output 164 of flip-flop 156. Due to the occurrence of HI signals on both Q output 142 of flip-flop 134 and $\overline{Q}$ output 166 of flip-flop 158, the HI signal at Q output 142 is provided through the RC circuit 159 to the reset (R) input of timing-out means 162 to reset such timing-out means and to hold it disabled. The HI signal at $\overline{Q}$ output 142 is also provided to the clock (C) input of flip-flop 158, but the occurrence of a HI signal on such clock (C) input during initialization has no effect since the HI signal at reset (R) input of flip-flop 158 effects resetting of such flip-flop independently of and without regard to the status of the clock (C) input.

The resetting of flip-flop 134 in response to the initialization signal as applied to lead 140 results in a low signal on Q output 144 of flip-flop 134. Since $\overline{Q}$ output 164 of flip-flop 156 goes HI during initialization, diode 146 will become forward biased with the result that the data (D) input of flip-flop 134 will be pulled LO by the LO signal on Q output 144 of flip-flop 134. Such LO signal on Q output 144 is also provided to driver means 148, which driver means amplifies and inverts such signal, thereby resulting in a HI signal on output 152 of driver array means 150, in light of which stamp movement means 154 will remain inoperative.

The resetting of flip-flop 158 during power-up similarly results in a LO signal at Q output 168 of flip-flop 158, which LO signal is provided to driver means 170 and 172 of driver array means 150, thereby effecting HI signals at outputs 173 and 174 of driver array means 150. In view of the HI signal at output 174, stamp detaching means 176 remains inoperative, and as a result thereof switch means 180, which is a cyclable cam operated switch in the preferred embodiment, remains in a normally closed position, as depicted in FIG. 5.

Figure 6:
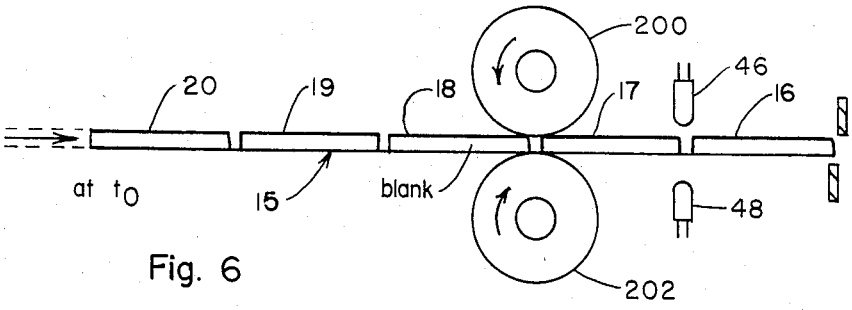
FIGS. 6–9 depict the stamp segment of FIG. 1 at various times of interest as the stamps thereon are scanned and dispensed by the embodiment of FIG. 5.

For proper operation of the preferred embodiment subsequent to system initialization, the roll of stamps to be vended should be positioned such that the perforations between the first stamp 16 on the stamp roll and the second stamp 17 are positioned between the light emitting diode 46 and phototransistor 48, as shown in FIG. 6, and the stamp 16 should be verified to be a valid stamp for reasons which will become apparent hereinafter. With the stamps so positioned, and with the system initialized as has previously been described, the embodiment depicted in FIG. 5 is prepared for operation, which operation will be commenced at time $t_0$ by the application of a HI dispense request signal to lead 132 and the communication of such signal thereover to the set (S) input of D-type flip-flop 134. Such dispense request signal may be generated by any of numerous means, which means are not considered a necessary part of the present invention. By way of example, the dispense request signal could be directly generated by a user of the system through the closure of a switch connected between lead 132 and a positive voltage source. Alternatively, the dispense request signal could be a vend signal produced by any number of vend control means when the amount of credit deposited by the customer is at least equal to the price of a stamp, some of which vend control means could be the vend control means described in U.S. Pat. No. 4,008,792, which is directed to vending control circuits capable of vending different quantities of postage stamps at different prices.

The application of a HI signal at the set (S) input of flip-flop 134 causes flip-flop 134 to be set, as a result of which $\overline{Q}$ output 142 goes LO, thereby resulting in the communication of a LO signal to the clock (C) input of flip-flop 158, to the reset (R) input of flip-flop 156, and to the reset (R) input of timing-out means 162. Such resetting of flip-flop 134 also causes Q output 144 thereof to go HI, thereby resulting in a LO signal at output 152 of driver array means 150, as a result of which stamp movement means 154 becomes operative and effects the movement of the stamps depicted in FIGS. 5 and 6 in the directions indicated by the arrows in such figures.

The occurrence of a LO signal at the reset (R) input of timing-out means 162 enables such means, as a result of which timing-out means 162 begins a counting or timing-out operation that will culminate in the production of a HI signal at output 190 of timing-out means 162 if a HI signal is not re-applied to the reset (R) input of timing-out means 162 prior to completion of the timing-out operation. The purpose of the timing-out means 162 and the effect of a production of a HI signal at output 190 thereof will be explained further hereinafter.

At the time that the dispense request signal is provided to the set (S) input of flip-flop 134, the roll of stamps is positioned such that the perforations between two successive stamps on the roll are positioned between light-emitting diode 46 and phototransistor 48, as has already been discussed. In such state, the conductivity of phototransistor 48 is relatively high and, when the adjustable contact 64 of potentiometer 62 is positioned nearer to collector 52 than to the positive voltage source, the resulting voltage present at adjustable contact 64 of potentiometer is relatively low. As should be clear from the previous discussions regarding FIGS. 3 and 4, the output voltage at lead 53 of the scanning means circuit 45 is lowest when the perforations between two stamps are disposed immediately intermediate the light-emitting diode 46 and phototransistor 48, and higher when non-perforated areas of the stamp roll are disposed between such scanning means. By judicious selection of a positive voltage source and appropriate adjustment of the adjustable contact 64 of potentiometer 62, a user of the depicted embodiment of FIG. 5 can determine a voltage range within which he wishes the output voltage of the scanning means to fall. Depending upon such selection and adjustment, the analog voltage range of the voltage signal produced at adjustable contact 64 may be large, intermediate, or small, but the time-voltage waveform of such analog voltage signal for stamp roll segment 15 will track the time-voltage waveform depicted in FIG. 4.

The resulting analog voltage signal at adjustable contact 64 of potentiometer 62 is filtered by filter circuit 65 and provided to negative (−) input 70 of voltage comparator means 72. When stamp movement means 154, which in the preferred form includes one or more friction roller members, such as roller numbers 200 and 202, becomes operative due to a LO signal at output 152 of driver array means 150, and the stamp roll segment 15 therefore begins to move between the scanning means in the direction of the arrow, the analog voltage signal provided to negative (−) input 70 changes in accordance with FIG. 4. Voltage comparator means 72 compares such input signal with the analog voltage signal present at positive (+) input 74 and produces a LO digital output signal at output 90 whenever the analog voltage signal at the negative (−) input 70 is greater than the analog voltage signal at the positive (+) input 74. At all other times the pull-up resistor 122 and the positive voltage source to which it is connected hold the output 90 of voltage comparator means 72 HI. If the adjustable contact 80 of potentiometer 82 is adjusted to provide a reference voltage signal of a level corresponding to voltage level A on FIG. 4, output 90 of voltage comparator means 72 will initially be HI while the perforations between stamps 16 and 17 on the stamp roll segment 15 are disposed between the scanning means since the reference voltage A is greater than the analog voltage signal provided to negative (−) input 70. For reasons which will become more apparent hereinafter, with the embodiment of FIG. 5, reference voltage level A is chosen to be a value intermediate to the analog voltage levels that denote and differentiate HI and LO digital signals.

The analog voltage signal provided through filter circuit 65 to negative (−) input 70 of voltage comparator means 72 is also provided to positive (+) input 100 of voltage comparator means 102, which comparator means operates similarly to voltage comparator means 72, and whose output 120 is maintained HI by pull-up resistor 126 and the positive voltage source to which it is connected unless the analog voltage signal present at any point in time at negative (−) input 104 is greater than the analog voltage signal then present at positive (+) input 100. If the adjustable contact 114 of potentiometer 112 is adjusted to provide a reference voltage signal of a level corresponding to voltage level B on FIG. 4, output 120 of voltage comparator means 102 will initially be LO while the perforations between stamps 16 and 17 on the stamp roll segment 15 are disposed between the scanning means since the reference voltage B is greater than the analog voltage signal provided to positive (+) input 100.

The digital output signal at output 90 of voltage comparator means 72 is provided as an analog voltage signal to the negative (−) input 88 of another voltage comparator means 86, which comparator means also operates similarly to voltage comparator means 72 and 102, and whose output 116 is maintained HI by pull-up resistor 124 and the positive voltage source to which it is connected unless the analog voltage signal present at any point in time at negative (−) input 88 is greater than the analog voltage reference signal A then present at positive (+) input 84. If voltage reference signal A has been selected to have a value intermediate to the analog values which denote and differentiate HI and LO digital values, the digital output signal at output 116 of voltage comparator means 86 will initially be LO while perforations between stamps 16 and 17 on the stamp roll segment 15 are disposed between the scanning means since the analog voltage value of the HI digital signal provided from output 90 of voltage comparator means 72 to the negative (−) input 88 of voltage comparator means 86 is greater than the analog voltage value of voltage reference signal A provided to the positive (+) input of voltage comparator means 86. It will be appreciated by those skilled in the art that, with the interconnections noted, voltage comparator means 86 essentially functions as an inverter so that the signal at output 116 thereof is the binary complement of the signal at output 90 of voltage comparator 72.

As the stamps on the stamp roll segment 15 begin to move between the scanning means the analog voltage signal provided to negative (−) input 70 of voltage comparator means 72 and to positive (+) input 100 of voltage comparator means 102 will track the time-voltage signal of FIG. 4. As stamp 17 moves between the scanning means, no change in the outputs of any of the voltage comparator means 72, 86, and 102 will occur until the analog voltage value at negative (−) input 70 of voltage comparator means 72 exceeds the analog voltage reference signal A present at positive (+) input 74 of such comparator means. At such time the output signal at output 90 will go LO, and such LO signal will be communicated to both the clock (C) input of flip-flop 134 and negative (−) input 88 of voltage comparator means 86. The presence of a LO signal at the clock (C) input of flip-flop 134 will effect no change in the outputs of such flip-flop, but the change from a HI to a LO signal at negative (−) input 88 of voltage comparator means 86 will cause output 116 thereof to go HI since the analog voltage value of such LO signal at negative (−) input 88 will then be less than the value of reference signal A. Such HI output signal at output 116 is provided to the data (D) input of flip-flop 156, but will effect no change in the outputs of such flip-flop.

As stamp 17 on the stamp roll segment continues to move between the scanning means, no further changes in the outputs of the voltage comparator means occur until the value of the analog voltage signal provided to positive (+) input 100 of voltage comparator means 102 exceeds the value of reference signal B. At such time, the output 120 of voltage comparator means 102 will go HI since the voltage value present at the negative (−) input 104 thereof no longer is greater than the voltage value present at the positive (+) input 100 thereof.

Such HI signal at output 120 is communicated to the clock (C) input of flip-flop 156, and such change from a LO to a HI signal on the clock input while a HI signal is present at the data (D) input of such flip-flop causes the flip-flop to set, thereby causing the signal at $\overline{Q}$ output 164 to go LO. Such LO signal at $\overline{Q}$ output 164 is communicated through resistor 165 to the data (D) input of flip-flop 134, but the presence of such LO signal at such input results in no changes in the outputs of such flip-flop at such time.

As stamp 17 continues to move between the scanning means no further changes in the outputs of the voltage comparator means occur until the value of the analog voltage signal provided to positive (+) input 100 falls below the value of reference signal B. At such time, the output 120 of voltage comparator means 102 will return LO since the voltage value present at the negative (−) input 104 thereof will again be greater than the voltage value present at the positive (+) input 100 thereof. Such LO signal is communicated to the clock (C) input of flip-flop 156, but such change from a HI to a LO signal on the clock input effects no changes in the outputs of such flip-flop.

Further movement of stamp 17 produces no changes in the outputs of the voltage comparator means until the value of the analog voltage signal provided to negative (−) input 70 of voltage comparator means 72 falls below the value of reference signal A. At such time, the output signal at output 90 of voltage comparator means 72 will go HI since the voltage value present at the negative (−) input 70 thereof no longer is greater than the voltage value present at the positive (+) input 74 thereof.

Such HI signal at output 90 of voltage comparator means 72 is communicated to the negative (−) input 88 of voltage comparator means 86 and to the clock (C) input of flip-flop 134. Such HI signal at negative (−) input 88 of voltage comparator means 86 causes the output 116 thereof, which output signal is provided to the data (D) input of flip-flop 156, to go LO, for the reasons that have previously been explained with regard to the operation of voltage comparator means 86. The resulting change from a HI to a LO at the data (D) input of flip-flop 156 produces no change in the outputs of such flip-flop, but the previously noted change from a LO to a HI signal on the clock (C) input of flip-flop 134 while a LO signal is present at the data (D) input thereof causes such flip-flop to reset, thereby causing the signal at Q output 144 to go LO and the signal at $\overline{Q}$ output 142 to go HI. Such LO signal at Q output 144 is provided to driver means 148, resulting in a HI signal at output 152 of driver array means 150, as a consequence of which stamp movement means 154 will become inoperative and movement of the stamp roll segment between the scanning means will stop. When the stamp roll segment stops, the perforations between stamps 17 and 18 will then be positioned between the scanning means.

The HI signal produced at $\overline{Q}$ output 142 of flip-flop 134 is communicated to the clock (C) input of flip-flop 158, and such change from a LO to a HI signal on the clock input while a HI signal is present at the data (D) input causes the flip-flop to set, thereby causing the signal at Q output 168 to go HI and the signal at $\overline{Q}$ output 166 to go LO. Such HI signal at Q output 168 is provided to driver means 170 and 172, resulting in LO signals at outputs 173 and 174 of driver array means 150. As has previously been discussed, the signal at output 173 is made available for use by various vending control systems that find it desirable or advantageous to keep a count of the number of non-blank stamps vended.

Figure 7:
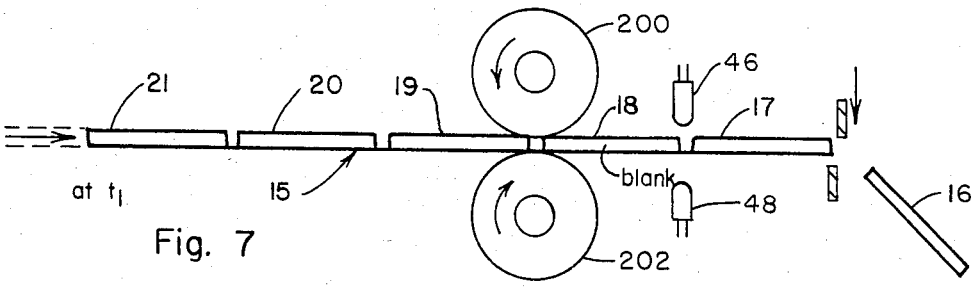

The LO signal produced at output 174 of driver array means 150 causes stamp detaching means 176 to become operative and to effect detachment of stamp 16 from the stamp roll segment 15. It will be recalled that when the positioning of the stamp roll segment between the scanning means was discussed it was indicated that, for the embodiment of FIG. 5, the first stamp on the roll should be a valid stamp. The reason for such requirement is apparent from FIGS. 6–9, wherein it can be readily observed that, for the particular dispensing system depicted, the stamp preceding the stamp which has just been scanned is the stamp that is actually detached and/or vended. Thus, FIG. 6 depicts the position of the stamp roll segment 15 at time $t_0$ when the system was first initialized, with stamp 16 positioned already past the light-emitting diode 46 and phototransistor 48, and with the perforations between stamps 16 and 17 disposed between the scanning means. FIG. 7 depicts the position of the stamp roll segment at time $t_1$, i.e., at the conclusion of the scanning of non-blank stamp 17 and immediately following operation of the cutting means 220 of stamp detaching means 176 to separate non-blank stamp 16 from the stamp roll segment 15 at the trailing boundary of stamp 16.

As stamp detaching means 176 operates it effects the cycling of cam switch 180 from its normally closed position to its normally open position and then back to the normally closed position. When the switch blade 222 transfers from normally closed contact 182 to normally open contact 178 the ground condition normally present between resistors 184 and 186 is removed, with the result that a HI signal from the positive voltage source connected to resistor 184 is provided to the reset (R) inputs of flip-flops 134 and 158 through resistors 184 and 186 and over leads 136 and 137. Such HI signal effects a re-initialization of the dispensing means 130 in the same manner as did the initialization signal during power-up. However, during such time as the switch blade 222 of full cycle switch 180 remains in contact with normally open contact 178 thereof the stamp detaching means remains operative due to the grounding of contact 178. The cycling operation of full cycle switch 180, with the attendant hold-on capability that is realized when switch 180 transfers to its normally open position, ensures that stamp detaching means 176 will remain operative sufficiently long enough to effect detachment of the appropriate stamp or stamps.

The LO signal which is produced at $\overline{Q}$ output 166 of flip-flop 158 when such flip-flop is set in response to the previously described clocking of the clock (C) input of such flip-flop ensures, in conjunction with RC circuit 159, that the reset (R) input of timing-out means 162 will be maintained LO despite the HI signal produced at $\overline{Q}$ output 142 of flip-flop 134. When the previously noted HI signal is produced at $\overline{Q}$ output 142 of flip-flop 134 due to the clocking of the clock (C) input thereof, RC circuit 159 acts to delay the communication of a HI signal to the reset (R) input of timing-out means 162 for a sufficiently long enough period to permit the LO signal produced on $\overline{Q}$ output 166 of flip-flop 158 to settle and to hold such reset (R) input LO through the then forward biased diode 167, thereby maintaining timing-out means 162 in an enabled state. As a consequence thereof, timing-out means 162 will continue its timing-out operation during such period without interruption.

In the event that switch blade 222 of full cycle switch 180 does not break contact with normally closed contact 182 thereof prior to the generation by timing-out means 162 of a HI timed-out signal at output 190 of timing-out means 162, the HI timed-out signal will be communicated through forward biased diode 192 and over leads 136 and 137 to the reset (R) inputs of flip-flops 134 and 158 to effect re-initialization of the dispensing control means 130 in the same manner as has previously been described with reference to the initialization signal initially applied to lead 140. Such timing-out means 162 will thus act to re-initialize the dispensing control system in the event of various possible system failures, such as a failure of the stamp movement means 154 or a failure of the stamp detaching means 176.

The foregoing has described the operation of the scanning and dispensing means when a non-blank stamp, such as stamp 17, is scanned and a non-blank stamp is dispensed. When the next stamp to be scanned is a blank stamp, though, such as is the case depicted at time $t_1$ in FIG. 7, the operation of the depicted embodiment proceeds somewhat differently. The scanning and dispensing operation begins in the same fashion, with the dispensing control means 130 initially in an initialized condition due to resetting of flip-flops 134 and 158. When a dispense request signal is provided to lead 132 and communicated thereover to the set (S) input of flip-flop 134, such flip-flop sets, as has been previously described, and effects operation of stamp movement means 154 to cause blank stamp 18 to begin to move between the light-emitting diode 46 and phototransistor 48. As such stamp moves between the scanning means the analog voltage signal provided to negative (−) input 70 of voltage comparator means 72 will exceed reference value A, as a consequence of which the output 90 of voltage comparator means 72 will go LO and such LO signal will be communicated to both the clock (C) input of flip-flop 134 and negative (−) input 88 of voltage comparator means 86. As has previously been explained, the presence of a LO signal at the clock (C) input of flip-flop 134 will effect no change in the outputs of such flip-flop, but the change from a HI to a LO signal at negative (−) input 88 of voltage comparator means 86 will cause output 116 thereof to go HI since the analog voltage value of such LO signal at negative (−) input 88 is then less than the value of reference signal A. Such HI output signal at output 116 is provided to the data (D) input of flip-flop 156, but effects no change in the outputs of such flip-flop.

As stamp 18 on the stamp roll segment 15 continues to move between the scanning means, the analog voltage signal provided to negative (−) input 70 of voltage comparator means 72 and positive (+) input 100 of voltage comparator means 102 tracks the time-voltage signal depicted in FIG. 4 for stamp 18. Since the value of such analog voltage signal never exceeds reference value B as stamp 18 moves between the scanning means, voltage comparator means 102 never operates during the scanning of such stamp to produce a HI signal on output 120 therof.

Figure 8:
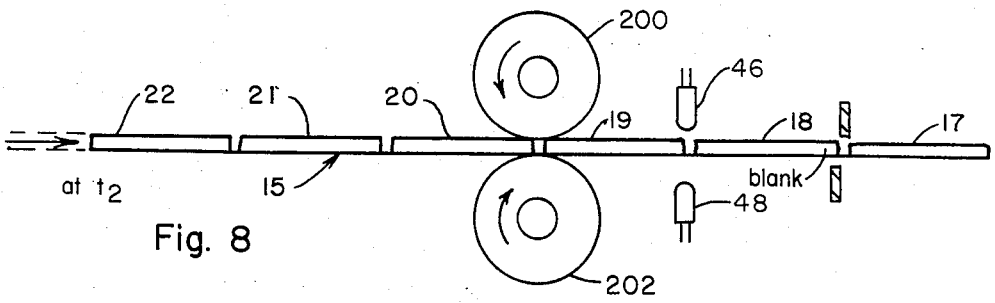

Instead, when stamp 18 moves between the scanning means at time $t_2$, as depicted in FIG. 8, so that the perforations between blank stamp 18 and stamp 19 become disposed between the scanning means, the analog voltage signal provided to negative (−) input 70 of voltage comparator means 72 falls below reference value A and the output 90 of such comparator means therefore returns HI. At such time flip-flop 134 is in a set condition and flip-flop 156 is in a reset condition, and the signals at both Q output 144 of flip-flop 134 and $\overline{Q}$ output 164 of flip-flop 158 are therefore HI, as a consequence of which the signal provided to the data (D) input of flip-flop 134 at such time is also HI.

The HI signal produced at output 90 of voltage comparator means 72 due to the detection of the perforations between blank stamp 18 and stamp 19 at time $t_2$ is provided to the clock (C) input of already set flip-flop 134. The change from a LO to a HI signal on the clock (C) input while a HI signal is present at the data (D) input causes the flip-flop to remain set, as a consequence of which Q output 144 remains HI and the stamp movement means remains operative. The stamp roll segment 15 therefore continues to move between the scanning means and, as the perforations between blank stamp 18 and non-blank stamp 19 move beyond the scanning means and stamp 19 begins to move between such scanning means, the analog voltage signal provided to negative (−) input 70 of voltage comparator means 72 and positive (+) input 100 of voltage comparator means 102 tracks the time-voltage signal depicted in FIG. 4 for stamp 19. When such analog voltage signal exceeds reference value A the output 90 of voltage comparator means 72 again goes LO and causes the output 116 of voltage comparator means 86 to go HI. As has been explained previously, such HI signal at output 116 effects no change in the state of flip-flop 156, and the LO signal at output 90 of voltage comparator means 72 effects no change in the state of flip-flop 134. The LO signal at output 90 is also provided to the clock (C) input of flip-flop 134, but effects no change in the outputs thereof.

Figure 9:
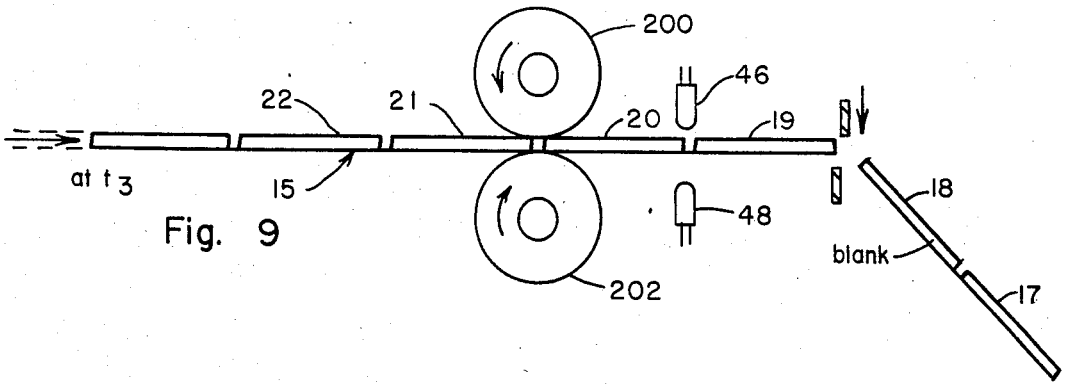

As non-blank stamp 19 continues to move between the scanning means, such scanning means and the dispensing control means 130 operate in the manner previously described with reference to the scanning of non-blank stamp 17, the end result of which is operation of stamp detaching means 176 at time $t_3$, as depicted in FIG. 9, to detach the stamp pair including non-blank stamp 17 and blank stamp 18 from the stamp roll segment 15 at the trailing boundary of stamp 18, i.e., at the perforations between blank stamp 18 and non-blank stamp 19. At such time movement of the stamp roll segment 15 will have ceased and the perforations between stamps 19 and 20 will be disposed between the scanning means. The dispensing control means 130 will have been re-initialized and be awaiting receipt of the next dispense request signal.

In light of the foregoing, it will be appreciated that the described embodiment of FIG. 5 will operate in such a manner that a blank stamp in a stamp roll will not be individually dispensed or vended to a customer or user as a valid stamp. Rather, the system will continue to scan the stamp roll segment until a non-blank stamp is detected, and then and only then will the stamp detaching means operate. It is therefore possible that a customer may receive more than one stamp during any particular vend operation, but one of the stamps in the stamp roll segment dispensed to him will be a non-blank stamp.

It will be appreciated by those skilled in the art that, because of its unique design and operation, especially with regard to the continued movement of the stamps on the stamp roll segment past the scanning means until a non-blank stamp is detected, the preferred embodiment is self-loading when the end of the stamp roll is fed to the stamp movement means and a dispense request signal is then applied to the embodiment to effect loading. Once such loading has been commenced, the stamp movement means will continue to operate and to move stamps past the scanning means until a non-blank stamp is detected and properly positioned for subsequent dispensing. Such self-loading feature, while not essential to the practice of the invention, is highly advantageous and desirable and simplifies the servicing and reloading of stamp dispensers by service personnel.

While the preferred embodiment described hereinabove fulfills the various objects and advantages sought therefor, it should be clearly recognized that such embodiment is only one possible system embodiment and that many other embodiments and applications of the present invention may exist or be employed. For example, a microprocessor may be utilized as the dispensing control means 130, and may be so programmed to be responsive to dispense request signals and to the outputs of the voltage comparator means to control the operations of the stamp movement means 154 and the stamp detaching means 176. In other applications, the stamp movement means may include, instead of frictional drive members, and by way of example and not of limitation, a known sprocket drive means, such as the type briefly discussed hereinabove, or a user operable manual advancement means with a locking and unlocking means, which locking and unlocking means can be unlocked to permit user operation of the manual advancement means and locked to prevent further user operation of the manual advancement means. Similarly, the stamp detaching means, instead of including cutting blades, may include, by way of example, various means for effecting or simply permitting stamp detachment, such as a means for gripping at least the first stamp which is not to be vended while permitting the customer to tear off the stamps being dispensed at the perforations located between the stamps to be vended and the remaining stamps on the roll. With such a stamp detachment means, a feeler switch, an optical coupler, or various other means might be employed in place of the cam operated switch 180 to detect a vending or dispensing operation and to effect re-initialization of the dispensing control means.

It should also be appreciated that the voltage comparator means 72 and 86 of the preferred embodiment are principally employed for the purpose of detecting boundaries between two successive stamps on a stamp roll and for conditioning the dispensing control means to check after the occurrence of a first boundary condition and before the occurrence of a second boundary condition for a non-blank condition. If and only if such non-blank condition is detected prior to the occurrence of a second boundary condition will the stamp movement means be rendered inoperative and the stamp detaching means rendered operative. Otherwise, the stamp detaching means will remain inoperative, the stamp movement means will continue to be operative, and the dispensing control means will proceed to check for the occurrence of a non-blank condition between the boundaries of the next stamp to be examined. It can thus be observed that the present invention can also be readily employed with rolls of stamps or other stamp-like items wherein boundaries between two successive items on the roll are not denoted by perforations but can be detected or otherwise readily determined or calculated. For example, the boundary between two successive items on a roll could be denoted by the occurrence at each boundary of a line marker of darker color than the remainder of the individual items. In such event, an optical scanning technique similar to that employed in the embodiment of FIG. 5 could be utilized in conjunction with voltage comparator means and a suitable reference value to detect each occurrence of a boundary condition, and a suitable dispensing control means could then check for the occurrence of a non-blank condition between the occurrences of the boundary conditions.

Figure 10:
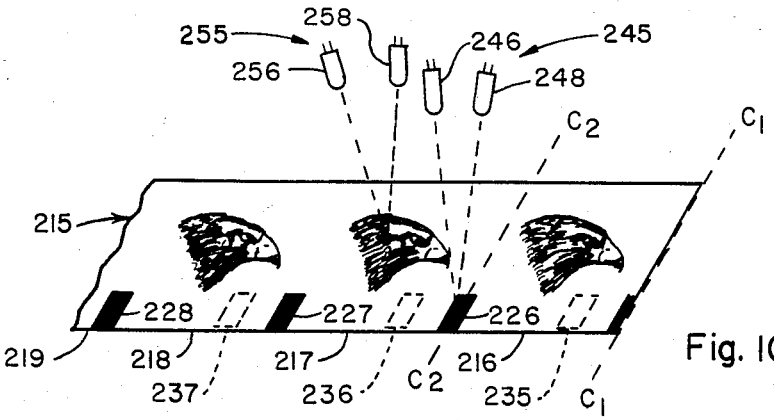
FIG. 10 is a perspective view of a strip segment of another stamp roll as it is being unwound and passed by the scanning means of an alternate embodiment, the scanning means of which detects the degree of reflectivity of each stamp.

Such a situation is depicted in FIG. 10, which figure shows a portion of an alternative scanning and dispensing means embodiment that employs separate scanning means for the detection of stamp boundaries and for the detection of non-blank stamps on a stamp roll which includes no perforations between successive stamps on the roll, but which does include distinguishable boundary markers or indicia for establishing stamp boundaries. As has previously been noted hereinabove, the opacity of a stamp on a stamp roll, at least insofar as such opacity is important to the present invention, can be readily determined by observing either the translucency or the reflectivity of such stamp. In the preferred embodiment already described hereinabove, the translucency of the stamps is monitored and the degree of translucency detected is utilized to detect stamp boundaries and non-blank stamps. It will be apparent that alternative embodiments could readily employ scanning means so positioned relative to the stamp segment to be able to detect the degree of reflectivity of each stamp as the stamps pass adjacent the scanning means. The scanning means depicted in FIG. 10 are so positioned and designed.

By way of brief description of the alternative embodiment of FIG. 10, the number 215 in such figure identifies a stamp roll segment including thereon stamps 216–219, which stamps are delimited from one another by stamp boundary markers 226–228. A first scanning means 245 including light-emitting diode 246 and phototransistor 248 is positioned to scan the stamps for boundary markers or indicia, which scanning means functions similarly to the scanning means of the preferred embodiment to detect occurrences of stamp boundaries. Unlike the scanning means 45 of the preferred embodiment, however, which scanning means detects the degree of translucency of the individual stamps, the scanning means 245 detects the degree of reflectivity. Scanning means 255 including light-emitting diode 256 and photodiode 258 is similarly designed and positioned to detect reflectivity, but is employed in the alternative embodiment of FIG. 10 for the purpose of identifying non-blank stamps and not for the purpose of detecting stamp boundaries. It will be readily apparent to those skilled in the art that a circuit embodiment similar to that of FIG. 5, with minor modifications thereto to provide for the separate scanning means for boundary markers or indicia and for non-blank stamps, and also to take into account reflectivity measurements instead of translucency measurements, could be employed with the stamp segment 215 and with the scanning means 245 and 255 depicted in FIG. 10. Consistent with the description of the preferred embodiment and its operation, a cutting or other stamp detaching means could be employed with the alternative embodiment of FIG. 10 to cut the stamp segment at location C1-C1 as noted in FIG. 10, in which event, as with the preferred embodiment, a non-blank stamp which has just been scanned will be positioned ahead of the scanning means but behind the cutting means. Such stamp will be dispensed as a non-blank stamp in response to the next dispense request signal in the same manner as was described with respect to the preferred embodiment.

It should be recognized, however, that the cutting or other stamp detaching means need not be positioned to always provide a one stamp "buffer" between the scanning means and the cutting means, such as is the case with the preferred embodiment, and with the alternative embodiment, as well, when the cutting means cuts the stamp segment at location C1-C1. Rather, the cutting means could be positioned to cut the stamp segment at a different location, such as at location C2-C2, in which event no stamp "buffer" would exist. Whether or not a stamp "buffer" is desired in any particular application, and, if so, the size of the "buffer", are decisions left to the discretion of the dispensing system manufacturer and user. For some applications, because of possible difficulties that could develop or be encountered, especially if it is desired to detach the stamp which has just been scanned at its trailing edge, boundary markers or indicia on the stamps might be provided at offset positions on the stamps, such as at the dotted positions 235–237 in FIG. 10, in which event the scanning means 245 could be slightly repositioned to the left of position in which it is presently shown in FIG. 10, the purpose and effect of which would be to alleviate space and clearance problems in the dispensing system, especially in the immediate area of the cutting means and at the location of the cut at C2-C2.

From the foregoing discussions, it will be appreciated that many variations and modifications of the present invention are possible, including uses of various means and methods for determining occurrences of stamp boundaries. With regard to such determinations of stamp boundaries it should be further apparent to those skilled in the art that, if all the stamps or other stamp-like items on the roll are of like size and if the movement of such items is uniform during periods when the stamp movement means is operative, the boundary between two successive items may be calculable or determinable other than by scanning the stamps. For example, it would be possible to determine boundary conditions by monitoring the rotation of a roller having means therewith or thereon for producing a boundary detection signal at a determined point or points of roller rotation. The boundary could also be calculable or determinable from the initial position of a leading item on the roll and from the speed of movement of the roll while the stamp movement means is operative. In such latter event, once an initial calculation or determination is made, whether by the designer of the system or by circuitry therein, a counting means could be utilized to signal a boundary condition, and the dispensing control means may be operated to check for the occurrence of non-blank conditions prior to a certain count.

From what has been said hereinbefore, it will be appreciated that numerous variations, uses, and applications of the present invention exist or may hereinafter become known, some few of which variations, uses, and applications that can be foreseen and anticipated have been briefly discussed hereinabove and are mentioned herein by way of example only and not of limitation. All such variations, uses, and applications, whether or not discussed hereinabove, are considered to be within the scope of the present invention, which is limited only by the claims which follow.

What is claimed is:

1. Scanning and dispensing means for use in a system for dispensing from a supply strip of serially ordered connected stamp-like items, which supply strip may contain invalid items interspersed among valid items, an output strip which includes one or more serially ordered connected items and at least one valid item for each invalid item included on such output strip, such system including means for producing dispense request signals, item movement means for effecting movement of the supply strip of items and the outputting of items contained thereon as such output strip during an item outputting operation, and item detaching means for use in effecting detachment of the output strip from the supply strip at the termination of such item outputting operation, said scanning and dispensing means comprising dispensing control means responsive to a dispense request signal to enable the item movement means and to thereby effect commencement of such item outputting operation, scanning means for sequentially optically scanning during such item outputting operation each item on the supply strip as the item passes thereby in order to detect the degree of opacity of such item and to produce a scanning output signal representative of such degree of opacity, the degree of opacity being determinative of the validity status of such item, boundary determination means operable to determine the occurrences of item boundaries as the supply strip of items passes by said scanning means and to produce a boundary detection signal when an item boundary occurs, and status detection means responsive to said scanning output signal to produce a status detection signal if the degree of opacity is representative of a particular validity status of the item, said dispensing control means responsive subsequent to such dispense request signal to productions of one or more of said boundary detection signals and status detection signals to control the operation of the item movement means and to effect the outputting on the output strip of at least one valid item for each invalid item included thereon, operation of the item movement means during the item outputting operation effecting the outputting for each item scanned of an item from the supply strip of items regardless of the scanned item's validity status, said dispensing control means operable during such item outputting operation to effect continuation of such item outputting operation if the last item scanned by said scanning means is an invalid item and to effect termination of such item outputting operation only upon the production of a boundary detection signal subsequent to a determination that the last item scanned by said scanning means is a valid item, such continuation of the item outputting operation being effected by further operation of the item movement means, such termination of the item outputting operation being effected by the disabling of the item movement means, said dispensing control means rendering the item detaching means usable upon termination of the item outputting operation.

2. The scanning and dispensing means of claim 1 wherein said status detection means is responsive during such item outputting operation to said scanning output signal to produce a status detection signal if the degree of opacity is representative of a valid item and wherein said dispensing control means is operable to effect termination of such item outputting operation only upon the production of a boundary detection signal subsequent to the production of a status detection signal.

3. The scanning and dispensing means of claim 1 wherein said dispensing control means includes a timing-out means, said timing-out means operable to effect a resetting of the dispensing control means if detachment of the output strip from the supply strip is not effected within a specified period following the receipt by the dispensing control means of a dispense request signal.

4. The scanning and dispensing means of claim 1 wherein said boundary determination means is responsive to said scanning output signal to determine occurrences of item boundaries.

5. The scanning and dispensing means of claim 1 wherein said scanning means includes first and second portions disposed on opposite sides of the supply strip, said first portion producing an optical output, said second portion being positioned to be and being responsive to said optical output and the translucency of the particular item on the supply strip disposed between said first and second portions to produce said scanning output signal.

6. The scanning and dispensing means of claim 5 wherein said first portion includes a light-emitting diode and said second portion includes a phototransistor for detecting the translucency of the item positioned between said light-emitting diode and said phototransistor.

7. The scanning and dispensing means of claim 1 wherein said scanning means includes first and second portions both disposed on the same side of the supply strip, said first portion producing an optical output, said second portion being positioned to be and being responsive to said optical output and the reflectivity of the item on the supply strip adjacent said first and second portions to produce said scanning output signal.

8. The scanning and dispensing means of claim 7 wherein said first portion includes a light-emitting diode and said second portion includes a phototransistor for detecting the reflectivity of the item adjacent said light-emitting diode and said phototransistor.

9. The scanning and dispensing means of claim 1 wherein said status detection means includes means for establishing a first preselected value and comparator means for comparing said scanning output signal and said first preselected value and for producing a status detection signal when the scanning output signal is at least equal to said first preselected value.

10. The scanning and dispensing means of claim 9 wherein said status detection means includes adjustment means operable to alter said first preselected value.

11. The scanning and dispensing means of claim 9 wherein said boundary determination means includes means for establishing a second preselected value and comparator means for comparing said scanning output signal and said second preselected value and for producing a boundary detection signal when said second preselected value is at least equal to said scanning output signal.

12. The scanning and dispensing means of claim 11 wherein said status detection means includes adjustment means operable to alter said first preselected value and said boundary determination means includes adjustment means operable to alter said second preselected value.

13. The scanning and dispensing means of claim 1 wherein said dispensing control means includes first, second, and third binary latch means, each of said latch means having an initial state and a transferred state, said first latch means being connected to receive dispense request signals and boundary detection signals, said first latch means being responsive to a dispense request signal to cause said latch means to latch in its transferred state, said latching of said first latch means in its transferred state enabling the item movement means to thereby effect movement of the supply strip of items past the scanning means, said second latch means being connected to receive status detection signals, said second latch means being responsive to a status detection signal to latch said second latch means in its transferred state, the receipt by said first latch means of a boundary detection signal while said second latch means is in its transferred state causing said first latch means to change from its transferred state to its initial state, said change of state of said first latch means from its transferred state to its initial state disabling the item movement means to thereby terminate movement of the supply strip of items, said third latch means responsive to the change in state of said first latch means from its transferred state to its initial state to cause said third latch means to latch in its transferred state, said latching of said third latch means in its transferred state enabling the item detaching means sufficiently long enough to effect detachment of the output strip from the supply strip, and means for effecting the return of said first, second, and third latch means to their initial states when the detachment of the output strip from the supply strip is effected.

14. The scanning and dispensing means of claim 13 wherein said dispensing control means includes a timing-out means, said timing-out means operable to effect the return of said first, second, and third latch means to their initial states if detachment of the output strip from the supply strip is not effected within a specified time period following the receipt by said first latch means of a dispense request signal.

15. The scanning and dispensing means of claim 14 wherein said latching of said first latch means in its transferred state enables said timing-out means and the return of both said first and third latch means to their initial states disables said timing-out means.

16. The scanning and dispensing means of claim 1 wherein said dispensing control means includes a programmable processing means.

17. The scanning and dispensing means of claim 16 wherein said processing means is programmed to sequentially (a) respond to a dispense request signal to enable the item movement means to thereby effect movement of the supply strip of items past said scanning means, (b) check for the production of a status detection signal and proceed to step (c) when such signal is produced, (c) respond to a boundary detection signal to disable the item movement means to thereby effect termination of movement of the supply strip of items and to enable the item detaching means for sufficiently long enough to effect detachment of the output strip from the supply strip, and, (d) recondition the dispensing control means for further operation and proceed to step (a).

18. The scanning and dispensing means of claim 17 wherein said processing means is further programmed to recondition the dispensing control means and proceed to step (a) if detachment is not effected within a specified time period following step (a).

19. The scanning and dispensing means of claim 17 wherein said processing means is a microprocessor.

20. Scanning and dispensing means for use in a system for dispensing one or more individual items from a strip of serially ordered stamp-like items, such system including means for producing dispense request signals, item movement means for effecting movement of the strip of items, and item detaching means for effecting detachment of one or more items from the strip, said scanning and dispensing means comprising scanning means for optically scanning each item on the strip as the item passes thereby in order to detect the degree of opacity of such item and to produce a scanning output signal representative of such degree of opacity, the degree of opacity being determinative of the status of such item, said scanning means including first and second portions disposed on opposite sides of the strip, said first portion producing an optical output, said second portion being positioned to be and being responsive to said optical output and the translucency of the particular item on the strip disposed between said first and second portions to produce said scanning output signal, boundary determination means operable to determine the occurrences of item boundaries as the strip of items passes by said scanning means and to produce a boundary detection signal when an item boundary occurs, status detection means responsive to said scanning output signal to produce a status detection signal if the degree of opacity is representative of a particular status of the item, and dispensing control means responsive to a dispense request signal and to productions subsequent thereto of one or more of said boundary detection signals and status detection signals to control the operation of the item movement means and item detaching means, said dispensing control means including first, second, and third binary latch means, each of said latch means having an initial state and a transferred state, said first latch means being connected to receive dispense request signals and boundary detection signals, said first latch means being responsive to a dispense request signal to cause said latch means to latch in its transferred state, said latching of said first latch means in its transferred state enabling the item movement means to thereby effect movement of the strip of items past the scanning means, said second latch means being connected to receive status detection signals, said second latch means being responsive to a status detection signal to latch said second latch means in its transferred state, the receipt by said first latch means of a boundary detection signal while said second latch means is in its transferred state causing said first latch means to change from its transferred state to its initial state, said change of state of said first latch means from its transferred state to its initial state disabling the item movement means to thereby terminate movement of the strip of items, said third latch means responsive to the change in state of said first latch means from its transferred state to its initial state to cause said third latch means to latch in its transferred state, said latching of said third latch means in its transferred state enabling the item detaching means sufficiently long enough to effect detachment of one or more items from the strip, and means for effecting the return of said first, second, and third latch means to their initial states when the detachment from the strip is effected.

21. The scanning and dispensing means of claim 20 wherein said boundary determination means is responsive to said scanning output signal to determine occurrences of item boundaries.

22. The scanning and dispensing means of claim 20 wherein said status detection means includes means for establishing a first preselected value and comparator means for comparing said scanning output signal and said first preselected value and for producing a status detection signal when the scanning output signal is at least equal to said first preselected value.

23. The scanning and dispensing means of claim 22 wherein said status determination means includes adjustment means operable to alter said first preselected value.

24. The scanning and dispensing means of claim 22 wherein said boundary determination means includes means for establishing a second preselected value and comparator means for comparing said scanning output signal and said second preselected value and for producing a boundary detection signal when said second preselected value is at least equal to said scanning output signal.

25. The scanning and dispensing means of claim 24 wherein said status detection means includes adjustment means operable to alter said first preselected value and said boundary determination means includes adjustment means operable to alter said second preselected value.

26. The scanning and dispensing means of claim 20 wherein said dispensing control means includes a timing-out means, said timing-out means operable to effect the return of said first, second, and third latch means to their initial states if detachment from the strip is not effected within a specified time period following the receipt by said first latch means of a dispense request signal.

27. The scanning and dispensing means of claim 26 wherein said latching of said first latch means in its transferred state enables said timing-out means and the return of both said first and third latch means to their initial states disables said timing-out means.

28. A microprocessor controlled scanning and dispensing means for use in a system for dispensing from a supply strip of serially ordered connected stamp-like items, which supply strip may contain invalid items interspersed among valid items, an output strip which includes one or more serially ordered connected items and at least one valid item for each invalid item included on such output strip, such system including means for producing dispense request signals, item movement means for effecting movement of the supply strip of items and the outputting of items contained thereon as such output strip during an item outputting operation, and item detaching means for use in effecting detachment of the output strip from the supply strip at the termination of such item outputting operation, said scanning and dispensing means comprising a microprocessor programmed to be responsive to a dispense request signal to enable the item movement means and to thereby effect commencement of such item outputting operation, scanning means for sequentially optically scanning during such item outputting operation each item on the supply strip as the item passes thereby in order to detect the degree of opacity of such item and to produce a scanning output signal representative of such degree of opacity, the degree of opacity being determinative of the validity status of such item, boundary determination means operable to determine the occurrences of item boundaries as the supply strip of items passes by said scanning means and to produce a boundary detection signal when an item boundary occurs, and status detection means responsive to said scanning output signal to produce a status detection signal if the degree of opacity is representative of a particular validity status of the item, said microprocessor programmed to be responsive subsequent to such dispense request signal to productions of one or more of said boundary detection signals and status detection signals to control the operation of the item movement means and to effect the outputting on the output strip of at least one valid item for each invalid item included thereon, operation of the item movement means during the item outputting operation effecting the outputting for each item scanned of an item from the supply strip of items regardless of the scanned item's validity status, said microprocessor programmed to operate during such item outputting operation to effect continuation of such item outputting operation if the last item scanned by said scanning means is an invalid item and to effect termination of such item outputting operation only upon the production of a boundary detection signal subsequent to a determination that the last item scanned by said scanning means is a valid item, such continuation of the item outputting operation being effected by further operation of the item movement means, such termination of the item outputting operation being effected by the disabling of the item movement means, said microprocessor programmed to render the item detaching means usable upon termination of the item outputting operation.

29. The microprocessor controlled scanning and dispensing means of claim 28 wherein said status detection means is responsive during such item outputting operation to said scanning output signal to produce a status detection signal if the degree of opacity is representative of a valid item and wherein said microprocessor is programmed to sequentially (a) respond to a dispense request signal to enable the item movement means to thereby effect movement of the supply strip of items past said scanning means, (b) check for the production of a status detection signal and proceed to step (c) when such signal is produced, and, (c) respond to a boundary detection signal to disable the item movement means to thereby effect termination of movement of the supply strip of items and to enable the item detaching means for sufficiently long enough to effect detachment of the output strip from the supply strip.

30. The microprocessor controlled scanning and dispensing means of claim 29 wherein said microprocessor is further programmed to terminate further performance of steps (b)–(c) if detachment is not effected within a specified time period following step (a).

31. The microprocessor controlled scanning and dispensing means of claim 28 wherein said boundary determination means is responsive to said scanning output signal to determine occurrences of item boundaries.

32. The microprocessor controlled scanning and dispensing means of claim 28 wherein said scanning means includes first and second portions disposed on opposite sides of the supply strip, said first portion producing an optical output, said second portion being positioned to be and being responsive to said optical output and the translucency of the particular item on the supply strip disposed between said first and second portions to produce said scanning output signal.

33. The microprocessor controlled scanning and dispensing means of claim 28 wherein said scanning means includes first and second portions both disposed on the same side of the supply strip, said first portion producing an optical output, said second portion being positioned to be and being responsive to said optical output and the reflectivity of the item on the supply strip adjacent said first and second portions to produce said scanning output signal.

34. The microprocessor controlled scanning and dispensing means of claim 28 wherein said status detection means includes means for establishing a first preselected value and comparator means for comparing said scanning output signal and said first preselected value and for producing a status detection signal when the scanning output signal is at least equal to said first preselected value.

35. The microprocessor controlled scanning and dispensing means of claim 28 wherein said boundary determination means includes means for establishing a second preselected value and comparator means for comparing said scanning output signal and said second preselected value and for producing a boundary detection signal when said second preselected value is at least equal to said scanning output signal.

36. A microprocessor controlled scanning and dispensing means for use in a system for dispensing from a supply strip of serially ordered connected stamp-like items, which supply strip may contain invalid items interspersed among valid items, an output strip which includes one or more serially ordered connected items and at least one valid item for each invalid item included on such output strip, such system including means for producing dispense request signals, each dispense request signal constituting a request for the dispensing of an output strip including a pre-established number of valid items, item movement means for effecting movement of the supply strip of items and the outputting of items contained thereon as an output strip during an item outputting operation, and item detaching means for use in effecting detachment of the output strip from the supply strip at the termination of such item outputting operation, said scanning and dispensing means comprising scanning means for sequentially optically scanning during such item outputting operation each item on the supply strip as the item passes thereby in order to detect the degree of opacity of such item and to produce a scanning output signal representive of such degree of opacity, the degree of opacity being determinative of the validity status of such item, boundary determination means operable to determine the occurrences of item boundaries as the supply strip of items passes by said scanning means, status detection means responsive to said scanning output signal to produce a status detection signal if the degree of opacity is representative of a valid item, and a microprocessor programmed to sequentially (a) respond to a dispense request signal both
  (1) to enable the item movement means to thereby effect movement of the supply strip of items past said scanning means and commencement of such item outputting operation and
  (2) to initiate determinations of occurrences of item boundaries as the supply strip of items moves past said scanning means,
(b) check for the production of a status detection signal to determine a valid item count and proceed to step (c) when such signal is produced, and
(c) check for the next occurrence of an item boundary and, upon such next occurrence of an item boundary, if the pre-established number of valid items for such dispense request have been detected, both
  (1) disable the item movement means to thereby effect termination of movement of the supply strip of items and
  (2) enable the item detaching means for sufficiently long enough to effect detachment of the output strip from the supply strip,
  otherwise return to step (b).

37. The microprocessor controlled scanning and dispensing means of claim 36 wherein said microprocessor is further programmed to terminate further performance of steps (a)–(c) if detachment is not effected within a specified time period following the enabling of the item movement means.

38. A microprocessor controlled scanning and dispensing means for use in a system for vending from a supply strip of serially ordered connected stamp-like items of a selected type, which supply strip may contain invalid items interspersed among valid items, an output strip which includes one or more serially ordered connected items of the selected type and at least one valid item for each invalid item included on such output strip, such system including item movement means for effecting movement of the supply strip of items and the outputting of items contained thereon as an output strip during an item outputting operation, item detaching means for effecting detachment of the output strip from the supply strip, credit entry means for the entry of credit by a customer, and customer actuatable item selection means for making a vend selection, said scanning and dispensing means comprising scanning means for sequentially optically scanning during such item outputting operation each item on the supply strip as the item passes thereby in order to detect the degree of opacity of such item and to produce a scanning output signal representative of such degree of opacity, the degree of opacity being determinative of the validity status of such item, boundary determination means operable to determine the occurrences of item boundaries as the supply strip of items passes by said scanning means and to produce a boundary detection signal when an item boundary occurs, status detection means responsive to said scanning output signal to produce a status detection signal if the degree of opacity is representative of a particular validity status of the item, and a microprocessor responsive to an actuation of the selection means to determine whether the credit entered by a customer is at least equal to the vend price of the selected vend selection and, if so, said microprocessor being thereafter responsive to subsequent productions of one or more of said boundary detection signals and status detection signals to control the operation fo the item movement means and to effect the outputting on the output strip of at least one valid item for each invalid item included thereon, operation of the item movement means during the item outputting operation effecting the outputting for each item scanned of an item from the supply strip of items regardless of the scanned item's validity status, said microprocessor programmed to operate during such item outputting operation to effect continuation of such item outputting operation if the last item scanned by said scanning means is an invalid item and to effect termination of such item outputting operation only upon the production of a boundary detection signal subsequent to a determination that the last item scanned by said scanning means is a valid item, such continuation of the item outputting operation being effected by further operation of the item movement means, such termination of the item outputting operation being effected by the disabling of the item movement means, said microprocessor programmed to render the item detaching means usable upon termination of the item outputting operation.

39. The microprocessor controlled scanning and dispensing means of claim 38 wherein said status detection means is responsive during such item outputting operation to said scanning output signal to produce a status detection signal if the degree of opacity is representative of a valid item and wherein said microprocessor operates to effect termination of such item outputting operation only upon the production of a boundary detection signal subsequent to the production of a status detection signal.

40. A microprocessor controlled scanning and dispensing means for use in a system for vending from a supply strip of serially ordered connected stamp-like items of a selected type, which supply strip may contain invalid items interspersed among valid items, an output strip which includes one or more serially ordered connected items of the selected type and at least one valid item for each invalid item included on such output strip, such system including item movement means for effecting movement of the supply strip of items and the outputting of items contained thereon as an output strip during an item outputting operation, item detaching means for use in effecting detachment of the output strip from the supply strip at the termination of such item outputting operation, credit entry means for the entry of credit by a customer, and customer actuatable item slection means for making a vend selection, said scanning and dispensing means comprising scanning means for sequentially optically scanning during such item outputting operation each item on the supply strip as the item passes thereby in order to detect the degree of opacity of such item and to produce a scanning output signal representative of such degree of opacity, the degree of opacity being determinative of the validity status of such item, boundary determination means operable to determine the occurrences of item boundaries as the supply strip of items passes by said scanning means, status detection means responsive to said scanning output signal to produce a status detection signal if the degree of opacity is representative of a particular status of the item, and a microprocessor responsive to an actuation of the selection means to determine whether the credit entered is at least equal to the vend price of the selected vend selection and, if so, to enter a dispensing mode of operation, said microprocessor programmed, upon entering its dispensing mode of opeation, to enable the item movement means to thereby effect movement of the supply strip of items past said scanning means and commencement of such item outputting operation, and to thereafter operate to monitor occurrences of item boundaries and productions of status detection signals to control the operation of the item movement means and to effect the outputting on the output strip of at least one valid item for each invalid item included thereon, operation of the item: movement means during the item outputting operation effecting the outputting for each item scanned of an item from the supply strip of items regardless of the scanned item's validity status, said microprocessor programmed to operate during such item outputting operation to effect continuation of such item outputting operation if the last item scanned by said scanning means is an invalid item and to effect termination of such item outputting operation only upon the production of a boundary detection signal subsequent to a determination that the last item scanned by said scanning means is a valid item, such continuation of the item outputting operation being effected by further operation of the item movement means, such termination of the item outputting operation being effected by the disabling of the item movement means, said microprocessor programmed to render the item detaching means usable upon termination of the item outputting operation, the microprocessor programming including the steps, prior to termination of such item outputting operation, of (a) checking for the production of a status detection signal and proceeding to step (b) when such signal is produced,
(b) checking for the next occurrence of an item boundary and, upon such next occurrence of an item boundary, proceeding to step (c), and
(c) disabling the item movement means to thereby effect termination of movement of the supply strip of items and the termination of such item outputting operation.

41. A system for scanning and dispensing from a supply stip of serially ordered connected stamp-like items, which supply strip may contain invalid items interspersed among valid items, an output strip which includes one or more serially ordered connected items and at least one valid item for each invalid item included on such output strip, comrpising means for producing dispense request signals, item movement means for effecting movement of the supply strip of items and the outputting of items contained thereon as such output strip during an item outputting operation, item detaching means for use in effecting detachment of the output strip from the supply strip at the termination of said item outputting operation, dispensing control means responsive to a dispense request signal to enable said item movement means and to thereby effect commencement of said item outputting operation, scanning means for sequentially optically scanning each item on the supply strip as the item passes thereby in order to detect the degree of opacity of such item and to produce a scanning output signal representative of such degree of opacity, the degree of opacity being determinative of the validity status of such item, boundary determination means operable to determine the occurrences of item boundaries as the supply strip of items passes by said scanning means and to produce a boundary detection signal when an item boundary occurs, and status detection means responsive to said scanning output signal to produce a status detection signal if the degree of opacity is representative of a particular validity status of the item, said dispensing control means responsive subsequent to said dispense request signal to productions of one or more of said boundary detection signals and status detection signals to control the operation of said item movement means and to effect the outputting on the output strip of at least one valid item for each invalid item included thereon, operation of the item movement means during the item outputting operation effecting the outputting for each item scanned of an item from the supply strip of items regardless of the scanned item's validity status, said dispensing control means operable during said item outputting operation to effect continuation of such item outputting operation if the last item scanned by said scanning means is an invalid item and to effect termination of such item outputting operation only upon the production of a boundary detection signal subsequent to a determination that the last item scanned by said scanning means is a valid item, such continuation of the item outputting operation being effected by further operation of the item movement means, such termination of the item outputting operation being effected by the disabling of the item movement means, said dispensing control means rendering the item detaching means usable upon termination of the item outputting operation.

42. The system of claim 41 wherein said item movement means includes means frictionally engageable with the strip of items and operable to move such strip past said scanning means.

43. The system of claim 41 wherein said item detaching means includes means therewith operable during an item detaching operation to effect reinitialization of said dispensing control means.

44. The system of claim 41 wherein said item detaching means includes cutting means.

45. The system of claim 41 wherein said item detaching means is operable to effect detachment at the leading boundary of the most recently scanned item for which a status detection signal has been produced.

46. The system of claim 41 wherein said item detaching means is operable to effect detachment at the trailing boundary of the most recently scanned item for which a status detection signal has been produced.

47. A method for scanning and dispensing from a supply strip of serially ordered connected stamp-like items, which supply strip may contain invalid items interspersed among valid items, an output strip which includes one or more serially ordered connected items and at least one valid item for each invalid item included on such output strip, such method for use with a system including item movement means for effecting movement of the supply strip of items and the outputting of items contained thereon as such output strip during an item outputting operation and item detaching means for use in effecting detachment of the output strip from the supply strip at the termination of such item outputting operation, comprising the steps of (a) providing scanning means for sequentially optically scanning each item on the supply strip as the item passes thereby in order to detect the degree of opacity of such item, the degree of opacity being determinative of the validity status of such item, and boundary determination means operable to determine the occurrences of item boundaries as the supply strip of items passes by said scanning means, (b) enabling the item movement means to thereby effect movement of the supply strip past said scanning means and to effect commencement of such item outputting operation, (c) optically scanning the items moving past said scanning means and effecting operation of said boundary determination means to control the operation of the item movement means and to effect the outputting on the output strip of at least one valid item for each invalid item included thereon, operation of the item movement means during the item outputting operation effecting the outputting for each item scanned of an item from the supply strip of items regardless of the scanned item's validity status, such control including (1) effecting continuation of such item outputting operation if the last item scanned by said scanning means is an invalid item, such continuation of the item outputting operation being effected by further operation of the item movement means, and (2) effecting termination of such item outputting operation only upon the production of a boundary detection signal subsequent to a determination that the last item scanned by said scanning means is a valid item, such termination of the item outputting operation being effected by the disabling of the item movement means, and (d) upon termination of such item outputting operation, rendering the item detaching means usable.

48. A method of operation of a scanning and dispensing means for use in a system for dispensing from a supply strip of serially ordered connected stamp-like items, which supply strip may contain invalid items interspersed among valid items, an output strip which includes one or more serially ordered connected items and at least one valid item for each invalid item included on such output strip, such system including means for producing dispense request signals, item movement means for effecting movement of the supply strip of items and the outputting of items contained thereon as such output strip during an item outputting operation, and item detachment means for use in effecting detachment of the output strip for the supply strip at the termination of such item outputting operation, the scanning and dispensing means including scanning means for sequentially optically scanning each item on the supply strip as the item pases thereby in order to detect the degree of opacity of such item, the degree of opacity being determinative of the validity status of such item, boundary determination means operable to determine the occurrences of item boundaries as the supply strip of items passes by said scanning means, and dispensing control means responsive to a dispense request signal and operable to control the operation of the item movement means and item detaching means, the method comprising the steps of (a) responding to a dispense request signal to enable the item movement means to thereby effect movement of the supply strip past said scanning means and commencement of such item outputting operation, (b) scanning the items passing by said scanning means and effecting operation of said boundary determination means to control the operation of the item movement means and to effect the outputting on the output strip of at least one valid item for each invalid item included thereon, operation of the item movement means during the item outputting operation effecting the outputting for each item scanned of an item from the supply strip of items regardless of the scanned item's validity status, such control including (1) effecting continuation of such item outputting operation if the last item scanned by said scanning means is an invalid item, such continuation of the item outputting operation being effected by further operation of the item movement means, and (b 2) effecting termination of such item outputting operation only upon the production of a boundary detection signal subsequent to a determination that the last item scanned by said scanning means is a valid item, such termination of the item outputting operation being effected by the disabling of the item movement means, and (c) upon termination of such item outputting operation, rendering the item detaching means usable.

49. Scanning and dispensing means for use in a system for dispensing one or more individual items from a strip of serially ordered connected stamp-like items, which strip may contain invalid items interspersed among valid items, such system including means for producing dispense request signals, item movement means for effecting movement of the strip of items, and item detaching means for effecting detachment of one or more items from the strip, said scanning and dispensing means comprising scanning means for optically scanning each item on the strip as the item passes thereby in order to detect the degree of opacity of such item and to produce a scanning output signal representative of such degrees of opacity, the degree of opacity being determinative of the validity status of such item, boundary determination means operable to determine the occurrences of item boundaries as the strip of items passes by said scanning means and to produce a boundary detection signal when an item boundary occurs, status detection means responsive to said scanning output signal to produce a status detection signal if the degree of opacity is representative of a particular validity status of the item, and dispensing control means responsive to a dispense request signal and to productions subsequent thereto of one or more of said boundary detection signals and status detection signals to control the operation of the item movement means and item detaching means, said dispensing control means being initially responsive to a dispense request signal to enable the item movement means to thereby effect movement of the strip past said scanning means, said dispensing control means thereafter being responsive only upon the production of a boundary detection signal subsequent to the production of a status detection signal representative of a valid item to disable the item movement means to thereby terminate movement of the strip and to enable the item detaching means sufficiently long enough to effect detachment of one or more items from the strip, said dispensing control means including a timing-out means, said timing-out means operable to effect a resetting of the dispensing control means if detachment of an item from the strip is not effected within a specified period following the receipt by the dispensing control means of a dispense request signal.

50. Scanning and dispensing means for use in a system for dispensing one or more individual items from a strip of serially ordered stamp-like items, such system including means for producing dispense request signals, item movement means for effecting movement of the strip of items, and item detaching means for effecting detachment of one or more items from the strip, said scanning and dispensing means comprising scanning means for optically scanning each item on the strip as the item passes thereby in order to detect the degree of opacity of such item and to produce a scanning output signal representative of such degree of opacity, the degree of opacity being determinative of the status of such item, boundary determination means operable to determine the occurrences of item boundaries as the strip of items passes by said scanning means and to produce a boundary detection signal when an item boundary occurs, status detection means responsive to said scanning output signal to produce a status detection signal if the degree of opacity is representative of a particular status of the item, and dispensing control means responsive to a dispense request signal and to productions subsequent thereto of one or more of said boundary detection signals and status detection signals to control the operation of the item movement means and item detaching means, said dispensing control means including first, second, and third binary latch means, each of said latch means having an initial state and a transferred state, said first latch means being connected to receive dispense request signals and boundary detection signals, said first latch means being responsive to a dispense request signal to cause said latch means to latch in its transferred state, said latching of said first latch means in its transferred state enabling the item movement means to thereby effect movement of the strip of items past the scanning means, said second latch means being connected to receive status detection signals, said second latch means being responsive to a status detection signal to latch said second latch means in its transferred state, the receipt by said first latch means of a boundary detection signal while said second latch means is in its transferred state causing said first latch means to change from its transferred state to its initial state, said change of state of said first latch means from its transferred state to its initial state disabling the item movement means to thereby terminate movement of the strip of items, said third latch means responsive to the change in state of said first latch means from its transferred state to its initial state to cause said third latch means to latch in its transferred state, said latching of said third latch means in its transferred state enabling the item detaching means sufficiently long enough to effect detachment of one or more items from the strip, and means for effecting the return of said first, second, and third latch means to their initial states when the detachment from the strip is effected.

51. The scanning and dispensing means of claim 50 wherein said dispensing control means includes a timing-out means, said timing-out means operable to effect the return of said first, second, and third latch means to their initial states if detachment from the strip is not effected within a specified time period following the receipt by said first latch means of a dispense request signal.

52. The scanning and dispensing means of claim 51 wherein said latching of said first latch means in its transferred state enables said timing-out means and the return of both said first and third latch means to their initial states disables said timing-out means.

53. A microprocessor controlled scanning and dispensing means for use in a system for dispensing from a supply strip of serially ordered connected stamp-like items, which supply strip may contain invalid items interspersed among valid items, an output strip which includes one or more serially ordered connected items and at least one valid item for each invalid item included on such output strip, such system including means for producing dispense request signals, item movement means for effecting movement of the supply strip of items and the outputting of items contained thereon as such output strip during an item outputting operation, and item detaching means for use in effecting detachment of the output strip from the supply strip at the termination of such item outputting operation, said scanning and dispensing means comprising a microprocessor programmed to be responsive to a dispense request signal to enable the item movement means and to thereby effect commencement of such item outputting operation, and scanning means for optically scanning during such item outputting operation the supply strip and the items thereof in sequence as the supply strip and the items thereof pass thereby in order to detect the degree of opacity thereof and to produce a scanning output signal the value of which is representative of such degree of opacity, particular degrees of opacity being determinative of item boundaries and of the validity status of such item, said microprocessor operatively connected to receive said scanning output signal, said microprocessor programmed to monitor said scanning output signal subsequent to such dispense request signal to detect scanning output signal values representative of item boundaries and the validity status of scanned items and further programmed to be responsive thereto to control the operation of the item movement means and to effect the outputting on the output strip of at least one valid item for each invalid item included thereon, operation of the item movement means during the item outputting operation effecting the outputting for each item scanned of an item from the supply strip of items regardless of the scanned item's validity status, said microprocessor programmed to operate during such item outputting operation to effect continuation of such item outputting operation if the last item scanned by said scanning means is an invalid item and to effect termination of such item outputting operation only upon the detection of a scanning output signal value representative of an item boundary subsequent to a determination that the last item scanned by said scanning means is a valid item, such continuation of the item outputting operation being effected by further operation of the item movement means, such termination of the item outputtting operation being effected by the disabling of the item movement means, said microprocessor programmed to render the item detaching means usable upon termination of the item outputting operation.

54. The microprocessor controlled scanning and dispensing means of claim 53 wherein said microprocessor is programmed to sequentially (a) respond to a dispense request signal to enable the item movement means to thereby effect movement of the supply strip of items past said scanning means, (b) check the scanning output signal for a scanning output signal value representative of a valid item and proceed to step (c) when such scanning output signal value is detected, and, (c) respond to a scanning output signal value representative of an item boundary to disable the item movement means to thereby effect termination of movement of the supply strip of items and to enable the item detaching means for sufficiently long enough to effect detachment of the output strip from the supply strip.

55. The microprocessor controlled scanning and dispensing means of claim 53 wherein said scanning means includes first and second portions disposed on opposite sides of the supply strip, said first portion producing an optical output, said second portion being positioned to be and being responsive to said optical output and the translucency of the particular item on the supply strip disposed between said first and second portions to produce said scanning output signal.

56. The microprocessor controlled scanning and dispensing means of claim 53 wherein said scanning means includes first and second portions both disposed on the same side of the supply strip, said first portion producing an optical output, said second portion being positioned to be and being responsive to said optical output and the reflectivity of the item on the supply strip adjacent said first and second portions to produce said scanning output signal.

57. A microprocessor controlled scanning and dispensing means for use in a system for dispensing from a supply strip of serially ordered connected stamp-like items, which supply strip may contain invalid items interspersed among valid items, an output strip which includes one or more serially ordered connected items and at least one valid item for each invalid item included on such output strip, such system including means for producing dispense request signals, each dispense request signal constituting a request for the dispensing of an output strip including a pre-established number of valid items, item movement means for effecting movement of the supply strip of items and the outputting of items contained thereon as an output strip during an item outputting operation, and item detaching means for use in effecting detachment of the output strip from the supply strip at the termination of such item outputting operation, said scanning and dispensing means comprising scanning means for optically scanning during such item outputting operation the supply strip and the items thereof in sequence as the supply strip and the items thereof pass thereby in order to detect the degree of opacity thereof and to produce a scanning output signal the value of which is representive of such degree of opacity, particular degrees of opacity being determinative of item boundaries and of the validity status of such items, and a microprocessor operatively connected to receive and monitor said scanning output signal, said microprocessor programmed to sequentially (a) respond to a dispense request signal both (1) to enable the item movement means to thereby effect movement of the supply strip of items past said scanning means and commencement of such item outputting operation and (2) to effect monitoring of said scanning output signal, (b) check the scanning output signal for a scanning output signal value representative of a valid item to determine a valid item count and proceed to step (c) when such scanning output signal value is detected, and (c) check the scanning output signal for the next scanning output signal value representative of an item boundary and, upon the detection thereof, if the pre-established number of valid items for such dispense request have been detected, both (1) disable the item movement means to thereby effect termination of movement of the supply strip of items and (2) enable the item detaching means for sufficiently long enough to effect detachment of the output strip from the supply strip, otherwise return to step (b).

* * * * *